US005953574A

United States Patent [19]

Okada

[11] Patent Number: 5,953,574

[45] Date of Patent: Sep. 14, 1999

[54] SHEET FEEDING APPARATUS AND IMAGE FORMING APPARATUS

[75] Inventor: Tamotsu Okada, Kawasaki, Japan

[73] Assignee: Canon Kabushiki Kaisha, Tokyo, Japan

[21] Appl. No.: 08/357,296

[22] Filed: Dec. 13, 1994

[51] Int. Cl.[6] ..... G03G 15/00; G03G 15/04

[52] U.S. Cl. ..... 399/374; 271/3.14; 271/301; 399/215

[58] Field of Search ..... 399/215, 367, 399/371, 373, 374; 271/3.14, 3.18, 3.19, 301

[56] References Cited

U.S. PATENT DOCUMENTS

| | | | |
|---|---|---|---|
| 4,319,833 | 3/1982 | Hidding | 355/23 |
| 4,456,236 | 6/1984 | Buddendeck | 399/373 X |
| 4,825,248 | 4/1989 | Honjo et al. | 399/371 X |
| 4,853,712 | 8/1989 | Piatt | 399/367 X |
| 5,091,755 | 2/1992 | Tashiro | 399/374 |
| 5,168,310 | 12/1992 | Hayashi et al. | 399/215 |
| 5,339,139 | 8/1994 | Fullerton et al. | 399/367 X |
| 5,438,435 | 8/1995 | Lawniczak | 399/364 X |
| 5,597,153 | 1/1997 | Maruyama et al. | 399/374 X |

*Primary Examiner*—Fred L Braun

*Attorney, Agent, or Firm*—Fitzpatrick, Cella, Harper & Scinto

[57] ABSTRACT

An original document feeding apparatus introduces an original document to a reading position to read image information of the original document, provided is a first delivery passage for delivering the original document from the reading position, a second deliverying passage branching off from the first delivery passage, and conveyance route switching unit selectively movable between a first position for introducing the original document to the first delivery passage and a second position for introducing the original document to the second delivery passage, each without projecting in the first delivery passage.

29 Claims, 11 Drawing Sheets

SHEET FEEDING APPARATUS AND IMAGE FORMING APPARATUS

BACKGROUND OF THE INVENTION

1. Field of the Invention

This invention relates to a sheet feeding apparatus and, more particularly, to an original document feeding apparatus, switchable of conveyance routes for original documents when the original documents formed with images on either one side or both sides thereof are to be read, and to an image forming apparatus using the original document feeding apparatus.

2. Description of Related Art

Automatic original document feeding apparatuses have been known so far in which an original document is automatically fed to a designated reading position to read its image information. As constitution to perform switching conveyance routes of the original document after the image thereon has been read, generally, a mechanism switching conveyance routes is pivotally arranged at a branching-off point of the routes so that the mechanism selects particularly during continuous reading of the original documents, if contacting an original document at which the image thereof is being read, the switching mechanism gives shocks to the original document, thereby causing image distortions or whatever. Hence, the reading position and the switching mechanism are designed to be isolated sufficiently, or the switching mechanism operates before the next original document is sent, thereby preventing the mechanism from contacting the original document at which the image is being read. Accordingly, its conveyance routes of original documents become longer, or longer periods of time intervals between documents increase processing time of original documents. Specially with updated digital image forming apparatuses having capabilities, such as, digital reading and memory retention, because copying becomes faster, it is difficult for the updated apparatuses, as their copying itself is done with a high speed, to complete reading of the original document within the copying time. To solve this problem, it is necessary to improve original document conveyance speed as well as to minimize the intervals between original documents. From such a view point, it is required to minimize time needed to switch the conveyance routes. However, there is a practical limit to shorten the time to operate the switching mechanism, and there is no workable way for an apparatus operating with smaller interval between original documents and higher conveyance speed.

SUMMARY OF THE INVENTION

It is an object of the invention to provide a sheet feeding apparatus switchable conveyance routes without affecting the sheet during recording or reading of images and to provide an image forming apparatus in use of the sheet feeding apparatus.

A typical original document feeding apparatus according to the invention to solve the problems above includes an introductory passage for introducing an original document to a reading position of image information of the original document, a first delivery passage for delivering the original document from the reading position, a second delivery passage branching off from the first delivery passage, and conveyance route switching means selectively movable to either a first position for introducing the original document to the first delivery passage or a second position for introducing the original document to the second delivery passage without projecting in the first delivery passage.

According to the original document feeding apparatus, when the conveyance route switching means moves to the first position, the switching means can introduce the original documents to the first delivery passage, and when moving to the second position, the switching means can form the second delivery passage different,from the first delivery passage. That is, the conveyance routes of the original documents are switched by moving the conveyance route switching means to either the first position or the second position. Since the conveyance route switching means does not project in the conveyance route of the first delivery passage, the switching means never contacts the original document in the first delivery passage even though the conveyance route switching means is moved while the image formed on the original document is being read. Therefore, it is possible to switch the conveyance route even during reading of image on the original document; the operation of the feeding apparatus is not be restricted by the conveyance speed or intervals of the original documents; the image processing speed is not reduced. Accordingly, the apparatus enables the image forming apparatus to complete image reading processing within a given total time and to process with high speed.

The original document feeding apparatus can further be constituted of an introductory passage for introducing an original document to a reading position for reading image information of said original document; a delivery passage for delivering said original document from said reading position; a reverse passage, connected to an end of said delivery passage, for reversing front and back sides of said original document; a reverse introductory passage, connected to the other end of said reverse passage, for reintroducing said reversed original document to said reading position; and conveyance route switching means, arranged at a branching off point between said delivery passage and said reverse introductory passage, for selectively switching to take either a first position for introducing said original document to said delivery passage or a second position for introducing said original document from said reverse introductory passage to the reading position without projecting in the first delivery passage.

According to this original document feeding apparatus, since the conveyance route switching means can switch the conveyance routes during passing of the original documents, the conveyance routes can be switched accurately during high speed feeding of the original documents or while the intervals of the original documents are short even without high switching speed (or high sensitive operation). In particular, if the original document feeding apparatus is installed in a mechanism handling both sides of documents, the mechanism can readily reverse the front and back sides of the original documents by the reverse passage and the conveyance route switching means, and therefore can improve reading speed of image information of so-called double sided original documents because both sides of the original documents are made to pass to the reading position.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Hereinafter, original document feeding apparatuses according to preferred embodiments will be described using the drawings.

Figure 1:
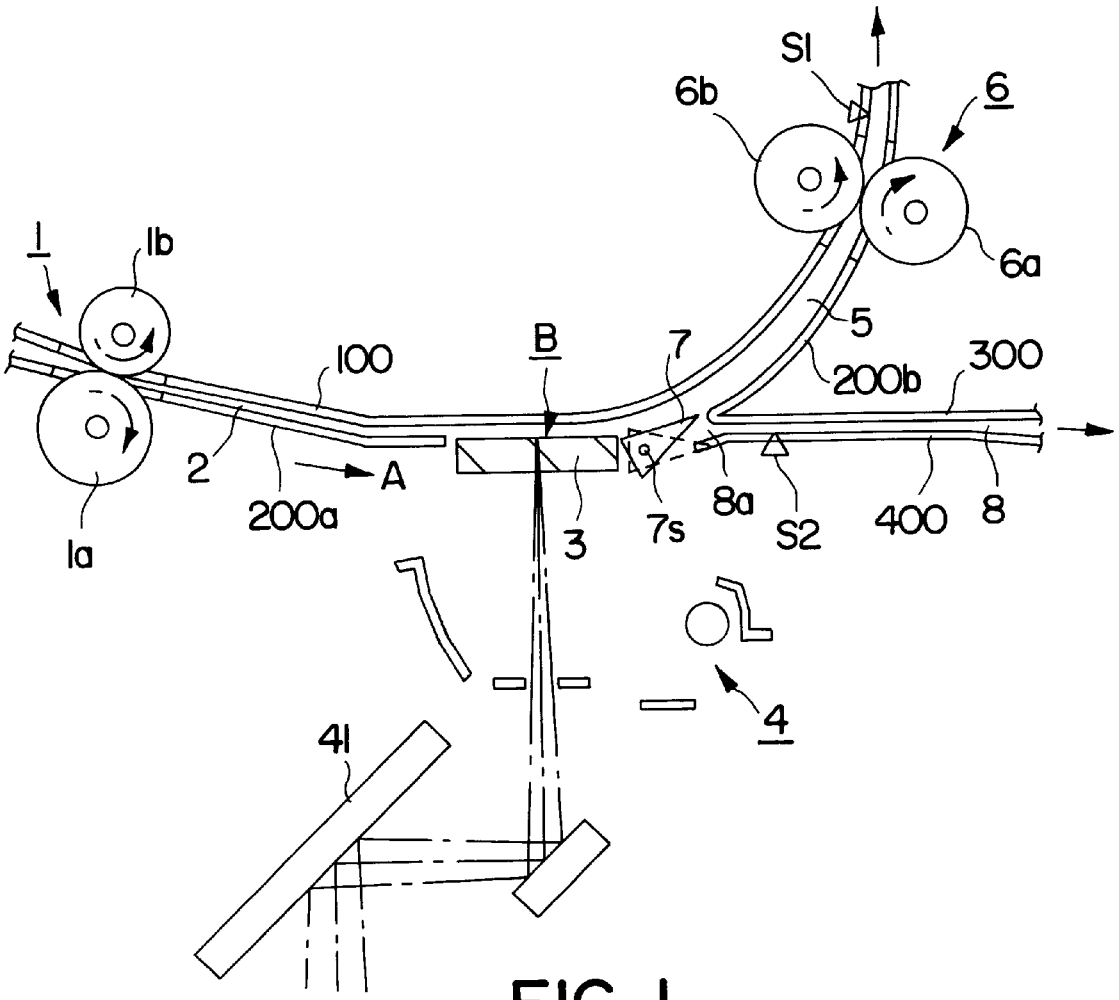
FIG. 1 is a side cross section showing an original document feeding apparatus according to a first embodiment of the invention.
Figure 2:
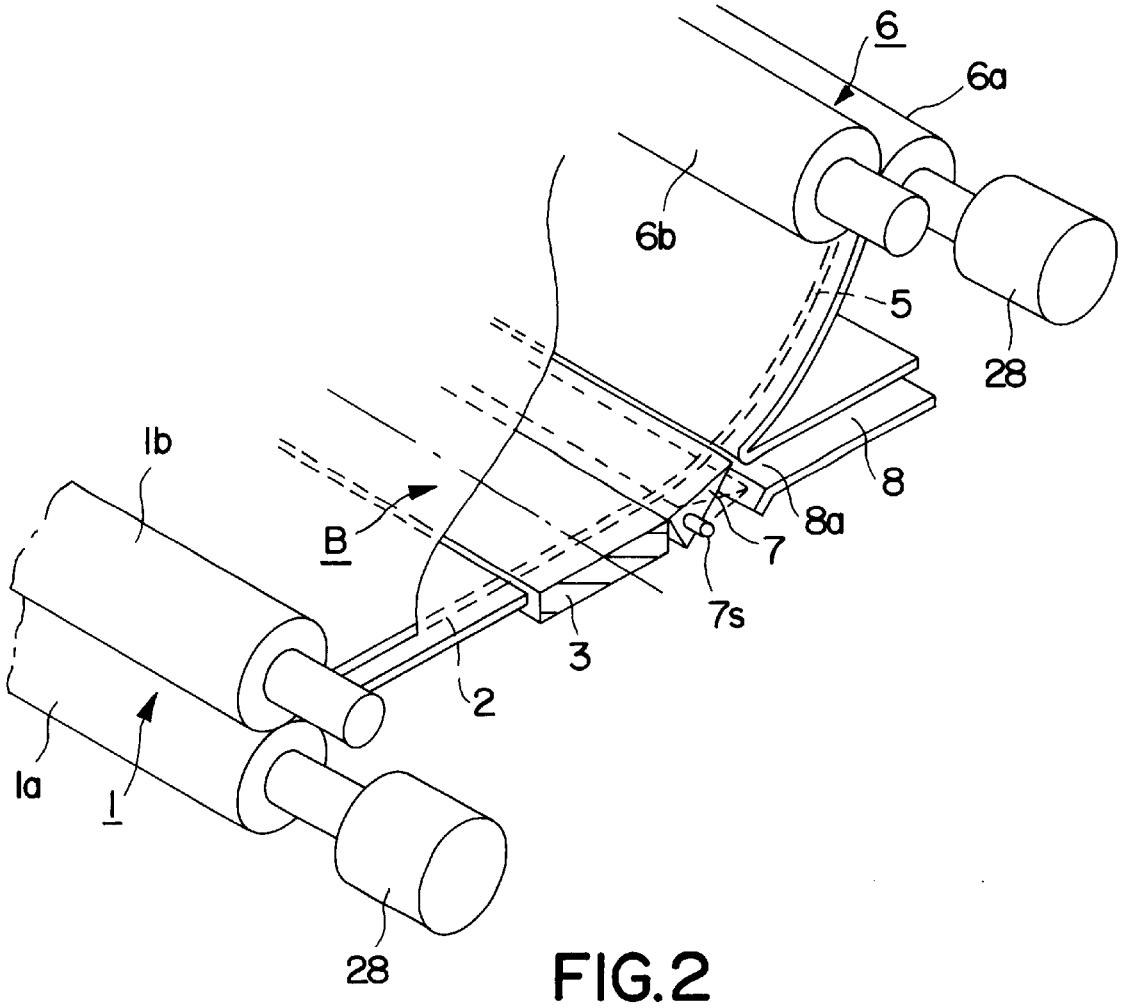
FIG. 2 is a perspective view showing the original document feeding in FIG. 1.

Referring to FIGS. 1, 2, there describes an original document feeding apparatus according to a first embodiment. In FIG. 1, an original document supplied from an original document supply unit which is described below, is conveyed by an introductory roller pair 1 through an inside of an introductory passage 2 constituted of an upper guide member 100 and a lower guide member 200*a* in a direction of an arrow A. A platen glass 3 is placed at a reading position B, and an optical system 4 for emitting original's image light onto an optical device (CCD or else) not shown or a photosensitive body is located at the opposing position (lower side in FIG. 1) to the platen glass 3. Light rays reflected at the original image are then reflected by a mirror 41 to the optical device (CCD or else) or the photosensitive body to record the image.

A first delivery passage 5 constituted of the upper guide member 100 and a lower guide member 200*b*, is arranged on a side downstream of the platen glass 3 as indicated by an arrow A, and a delivery roller pair 6, as conveying means for delivery, is provided on a further downstream side inside of the first delivery passage 5, thereby conveying original documents sent from the reading position B. A second delivery passage 8, different from the first delivery passage 5, is provided on the downstream side of the platen glass 3 in the direction of the arrow A and is composed of an upper guide member 300 and a lower guide member 400. A flap 7, making conveyance route switching means, is pivotably arranged at a branching-off point of the first delivery passage 5 and the second delivery passage 8 on the downstream side of the platen glass 3 in the direction of the arrow A. The flap 7 is a part in a flat plate shape, and is arranged to extend in a widthwise direction of the conveyance route. The flap 7 pivots, by driving means made of a rotary solenoid, around pivot centers 7*s* (located on an upstream side in the conveyance direction) formed at both sides thereof in a longitudinal direction. That is, the flap 7 pivots mainly at downstream side edge in the direction of the arrow A, and its movable range is indicated in FIG. 1 by a first position shown by a solid line and a second position shown by a broken line.

Figure 11A:
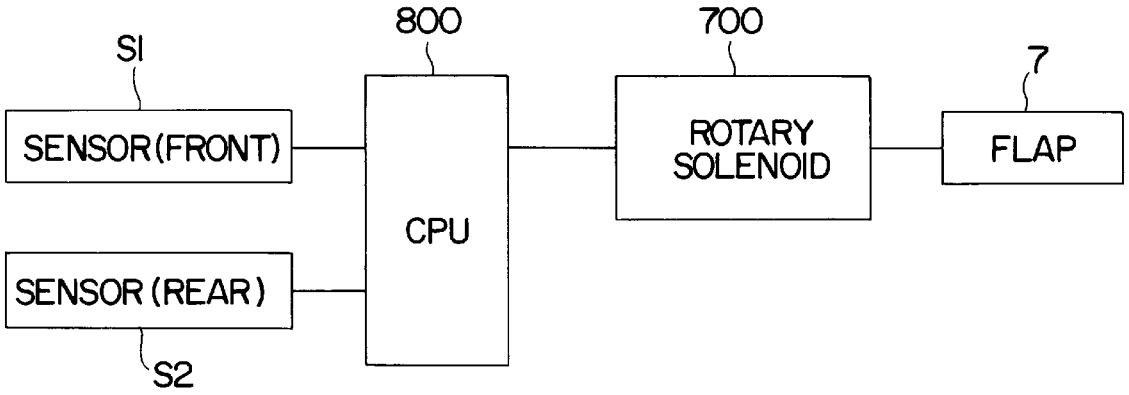
FIGS. 11(*a*) and (*b*) are each a block diagram showing a controller.
Figure 11B:
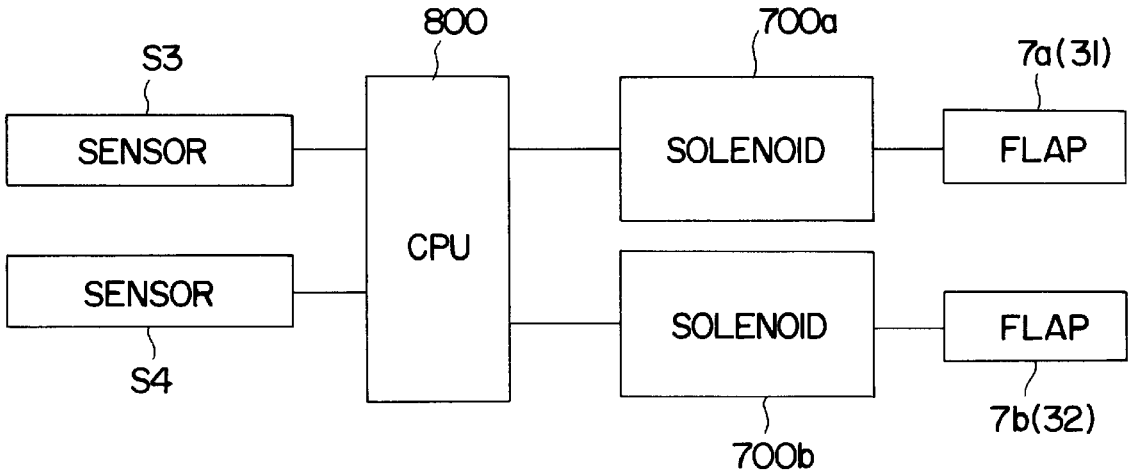

FIG. 11(*a*) shows a block diagram of a controller of the embodiment. The rotary solenoid 700 for driving the flap 7 is connected to a CPU 800 and is thereby controlled with optimum timings based on information of the original document's position from sensors S1, S2. The operation of the flap 7 will be described below. When located at the first position, the flap 7 forms the same surface as that of the lower guide member 200*b* of the first delivery passage 5, thereby forming a part of the first delivery passage 5 and shutting up an opening 8*a* of the second delivery passage 8. On the other hand, when moving to the second position, the flap 7 forms the same surface of that of the lower guide member 400 of the second delivery passage 8, thereby forming a part of the second delivery passage 8. At that time, a straight conveyance route is established by linking the introductory passage 2, the reading position B, and the second delivery passage 8 on the downstream side of the platen glass 3 in the direction of the arrow A. The delivery passage 8 delivers the following original documents onto such as a tray in a manner different from the first delivery passage 5 (for example, reversing back and front). When the flap 7 is located at the second position, although the first delivery passage 5 is not closed, the passage from the introductory passage 2 to the second delivery passage 8 makes itself a straight conveyance route as described above, so that no original document will be mistakenly introduced to the first delivery passage 5.

The original documents passed from the introductory passage 2 through the reading position B are thus assigned by the flap 7 under designated conditions to either the first delivery passage 5 or the delivery passage 8. Upon the confirmation of passing of the original documents by the sensors S1, S2, the flap 7 operates in conjunction with timings to assign the following original documents. While an original document is passing over the reading position B, the image thereon is read. It is to be noted that the tip of the flap 7 is desirably made to project from the lower guide member 200*b* to prevent the original documents from sticking.

The sensors S1, S2 are not only to be located at the positions shown in the drawings and can be located, for example, between the flap 7 and the delivery roller pair 6. Even if so, the movement of the flap 7 is controllable by the same way as described above. Although the control method for operation timings of the flap 7 is not specifically restricted, it is desirable to make the flap 7 operate after the original document arrives at either of conveyance roller pairs placed on the downstream side in the conveyance direction. It is therefore possible to control the operation timings of the flap 7 by providing sensor means for sensing the front end of the original documents. Such controlling is to be properly set in accordance with conveyance speed of the original documents at the original document feeding apparatus or with intervals between the original documents.

In the embodiment above, the conveyance roller pairs arranged at upstream and downstream sides of the position B transfer the original documents without providing any handling means such as belts, or rollers, of the original documents at the reading position B. In such a system with handling means, impairments such as image distortions might occur if the system receives even slight shock during reading of the original documents. In this original document feeding apparatus, however, the flap 7 while moving, never contacts the original document being carried, and therefore, the apparatus is capable of reading the original documents under more stable conditions.

As described above, the original document feeding apparatus to which the flap 7 is attached can form, without adversely affecting the original documents being carried, the conveyance route of the second delivery passage 8 while the images on the original documents are continuously read. The apparatus is thus able to make the conveyance routes of the original documents switchable continuously or selectively between the first delivery passage 5 and the delivery passage 8, thereby being capable of assorting, reversing, and the like of the original documents without affecting original document processing time.

Referring to FIG. 2, a drive system composed of the introductory roller pair 1 and the delivery roller pair 6, which are arranged on the upstream and downstream sides, respectively, of the reading position B. The respective roller pairs 1, 6 are composed of respective driving rollers 1*a*, 6*a* and respective driven rollers 1*b*, 6*b* and are constituted so that the original documents are pressed between those driving rollers 1*a*, 6*a* and those driven rollers 1*b*, 6*b* to be transferred in a designated direction. The driving rollers 1*a*, 6*a* of the respective roller pairs 1, 6 are directly connected to each output shaft of a motor 28 with their shafts through certain couplings and are constituted of, so called, a direct drive system. That is, by constituting the driving rollers 1*a*, 6*a* of the conveyance roller pairs 1, 6 as of the direct drive system, the apparatus can get rid of backlashes occurring at the drive power transmission system using gearage, belts' expansions occurring at the drive power transmission system using belts or the like, and any other occurrence sources of shocks occurring at entrance and release of the original documents due to plays or backlashes of gears, pulleys for belts, roller shafts, and the output shaft of the motor. The apparatus can also get rid of vibrations due to swings of gears or pulleys themselves.

Figure 3:
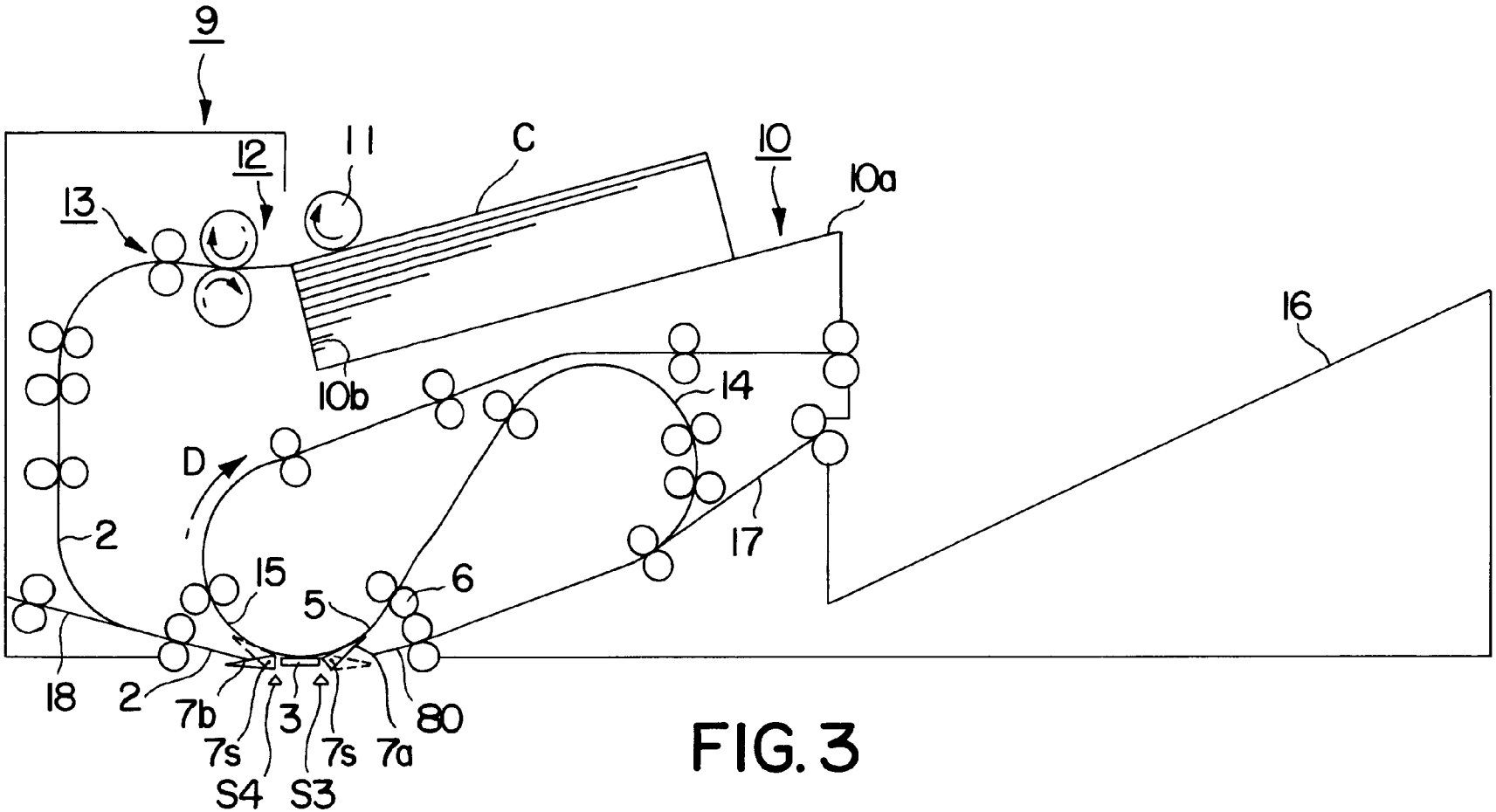
FIG. 3 is a side cross section showing an original document feeding apparatus according to a second embodiment of the invention.

Referring to FIG. 3, the entire constitution of an original document feeding apparatus according to a second embodiment is described. The original document feeding apparatus shown in FIG. 3 arranges respective flaps 7, 7 on both sides of the platen glass 3 and is constituted so as to read the image formed on both sides of an original document by conveying the original document in two ways at the reading position B upon reversing the original document. In this embodiment, the second delivery passage 8 of the first embodiment is used as a reverse introductory passage 80 for re-introducing the original documents to the reading position; a reverse delivery passage 15 is also provided as to branch off the introductory passage 2. It is to be noted that portions indicating the same portion in the drawings and having the same function as those of the first embodiment above are given the common reference numbers to omit their descriptions.

In FIG. 3, the original document feeding apparatus 9 has an original document base 10 for putting plural original documents C thereon. The document base 10 is formed with a document face 10*a* gently inclined and a side end face 10*b* provided at a lower end of the document face 10*a* for positioning ends of original documents C. A supply roller 11 is located at an upper position on the side of the side end face 10*b* of the document base 10 and contacts the upmost original document on the document base 10 with designated pressure. By turning the supply roller 11 in an arrow direction, the original documents can be subsequently fed from the upmost original document C. The original document C fed by the supply roller 11 is prevented from being sent doubly by isolation rollers 12, so that a sole sheet of the original document C is fed to a conveyance roller pair 13 and then into the introductory passage 2.

A platen glass 3 is arranged at a reading position B. Flaps 7*a*, 7*b* are placed on both sides of the platen glass 3, respectively, so as to be pivotable between a first position (position indicated by a solid line in FIG. 3) and a second position (position indicated by a broken line in FIG. 3). When the flaps 7*a*, 7*b* are at the first position, an original document C conveyed from the introductory passage 2 is introduced into the first delivery passage 5. When the original document C introduced through the first delivery passage 5 reaches the delivery roller pair 6, the flap 7*a* moves to the second position and then waits upon opening the reverse introductory passage 80. The delivery passage 5 and the reverse introductory passage 80 are connected via a circulated reverse passage 14, and the original document C conveyed through the passages 5, 14, 80 changes its back and front sides. Accordingly, because the apparatus properly operates as far as the flap 7*a* switches the routes by when the original document is reversed and returned, the apparatus would be suitable for high speed feeding of original documents even though not so sensitive.

The flap 7*b* moves to the second position at the same time when the rear end of the original document whose front end has been introduced into the first delivery passage 5 passes by the flap 7*b*, and then, the flap 7*b* forms a reverse delivery passage 15, as a conveyance passage different from the introductory passage 2, located over the introductory passage 2. When the flaps 7*a*, 7*b* are located at the second position, the original document C is reversed through the first delivery passage 5, the reverse passage 14, and the reverse introductory passage 80, and is conveyed toward the left side of FIG. 3. At the reading position B, the image is read which is formed on the back of the original document C, and the document C is then introduced into the reverse delivery passage 15. The original document C is continuously conveyed in a direction of an arrow D, passes through the reverse delivery passage 15, and is delivered onto a delivery tray 16. When the rear end of an original document passes by the flap 7*a*, the flaps 7*a*, 7*b* are switched to occupy the positions indicated by the solid lines, thereby preparing for receiving following original documents. Accordingly, the flap 7*b* can be switched to occupy the position indicated by the solid line even during image reading.

FIG. 11(*b*) shows controller for the flaps 7*a*, 7*b*. Sensors S3, S4 arranged beside the flaps 7*a*, 7*b*, confirm that original document has passed the reading position B. The CPU 800 renders, based on the information from the sensors S3, S4, solenoids 700*a*, 700*b* operate to convey the original documents as described above.

By repeating this operation, the apparatus reads both sides of the original document C, on both sides of which image is formed, and is capable of continuously processing the original documents with the minimum intervals between the original documents. It is to be noted that it is possible to send the original documents with intervals such that plural sheets (for example, two) of the original documents are continuously sent through the reverse passage 14. In such a case, the original document of the third or above is alternatively sent. That is, after the first original document passed the platen glass 3, the third original document is to be fed, and after the second original document passed the platen glass 3, the fourth is to be fed.

With the original document feeding apparatus 9, in the case where original documents having an image on only one side are to be read, the flap 7*a* is moved to the second position indicated by the broken line, and the flap 7*b* is moved to the first position indicated by the solid line. Under this condition, the original document is conveyed from the introductory passage 2, thereby being delivered onto the delivery tray 16 from an one side delivery passage 17 after being read. The numeral 18 represents a manual feeding passage. It is capable of receiving special original documents and operating as for interruption, in cooperation with the one side delivery passage 17.

Figure 4A:
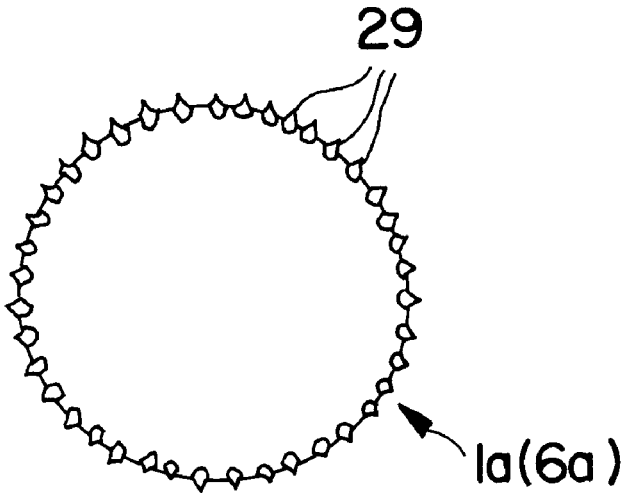
FIGS. 4(*a*) and (*b*) are each; a schematic illustration showing constitution of a driving roller of the second embodiment.
Figure 4B:
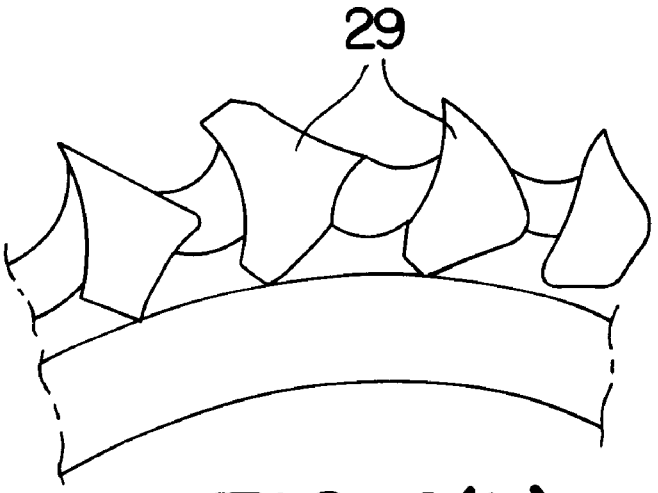

FIG. 4 shows construction of driving rollers 1*a*, 6*a* constituting the conveyance roller pairs 1, 6. FIG. 4(*a*) is a side view of the driving rollers 1*a*, 6*a* when viewed from their ends. FIG. 4(*b*) is a enlarged view partly showing the rollers. Spines 29 consisted of such as alumina are made to adhere to a surface of the driving rollers 1*a*, 6*a*. The tips of the spines 29 are made keen to increase friction coefficient of the driving rollers 1*a*, 6*a*, thereby surely gripping the surface of the original document to convey it. On the other hand, the surface of the driven rollers 1*b*, 6*b* is covered by elastic body such as rubber, the surface, even though the driving rollers 1*a*, 6*a* contact and push the original document, receives such pressure by utilizing its elasity, thereby ensuring holding of the driving rollers 1*a*, 6*a* for the original documents, and preventing the original documents from being damaged.

The driving rollers 1*a*, 6*a* thus formed with the spines 29 are capable of preventing as mush as possible the original documents from sliding on the roller during conveyance of the original documents. The roller pairs 1, 6 can be constituted with high durability by combinations of the driving rollers 1*a*, 6*a* with the spines 29 on their surface and the driven rollers 1*b*, 6*b* arranging elastic body at their surface.

Figure 5:
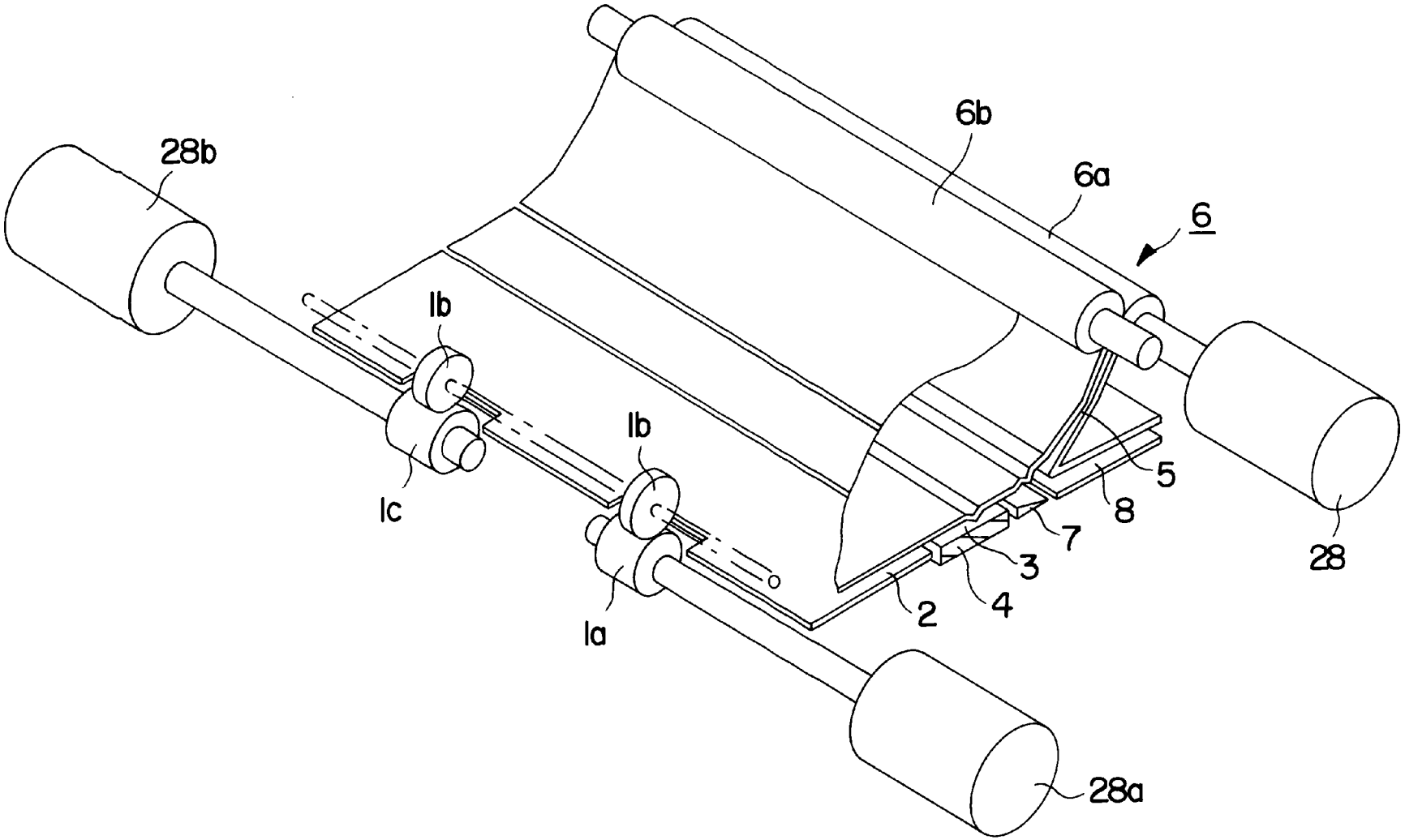
FIG. 5 is a perspective view showing an original document feeding apparatus according to a third embodiment of the invention.

Referring to FIG. 5, a third embodiment according to the invention will be described. This embodiment is an apparatus having constitution in which its introductory rollers correct oblique feeds of the original documents during the conveyance to the reading position B. It is to be noted that portions indicating the same portion in the drawings and having the same function as those of the first embodiment above are given the common reference numbers to omit their descriptions.

In this embodiment, the introductory roller pair 1 is constituted of independent driving rollers 1*a*, 1*c*. Motors 28*a*, 28*b* are directly coupled to the corresponding driving rollers 1*a*, 1*c*, respectively, and rotate the respective driving roller in a manner of the direct drive method. When the original document goes obliquely, the apparatus drives the respective motors 28*a*, 28*b* so as to correct oblique feeds, thereby correcting the oblique feeds of the original documents. An original document pushing member 10 is described below. It is to be noted that, as a matter of course, in the constitution of the third embodiment, the driving rollers 1*a*, 1*c* may have the spines 29 attached onto the surface thereof as shown in FIG. 4, and the driven roller 1*b* may have an elastic body applied onto the surface thereof.

Figure 6A:
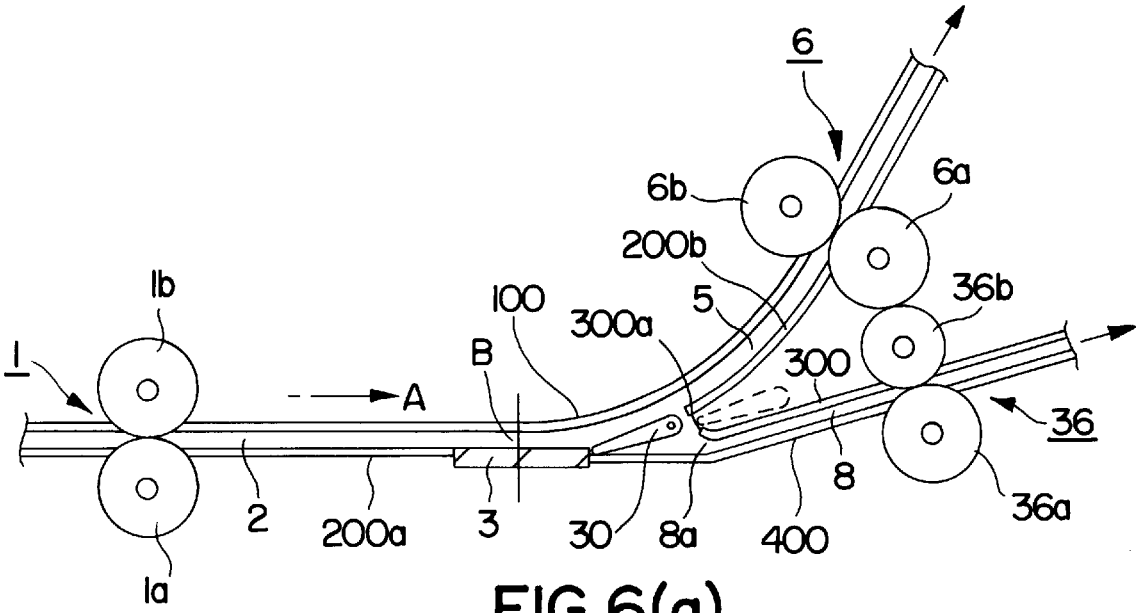
FIG. 6(*a*) is a side cross section showing an original document feeding apparatus according to a fourth embodiment of the invention and FIG. 6(*b*) is a partial perspective view.
Figure 6B:
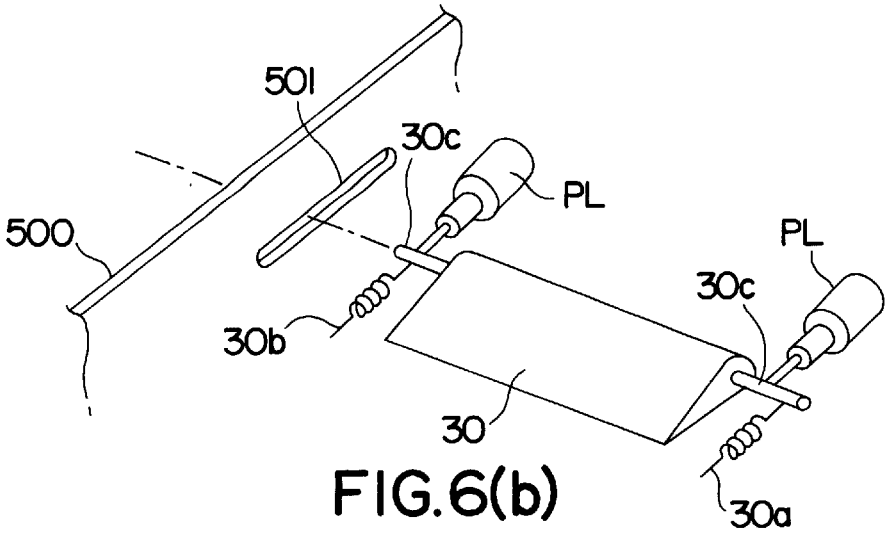

Referring to FIG. 6, another original document feeding apparatus according to a fourth embodiment is described. In this embodiment, a blade movable back and forth in the conveyance direction constitutes conveyance route switching means. It is to be noted that portions indicating the same portion in the drawings and having the same function as those of the first embodiment above are given the common reference numbers to omit their descriptions.

The original document feeding apparatus shown in FIG. 6(*a*) moves its blade 30 back and forth in the conveyance direction, or the blade's widthwise direction, so as to make the blade 30 move between a first position indicated by solid lines and a second position indicated by broken lines, thereby switching the conveyance routes of the original documents. When the blade 30 moves forward and is located at the first position, the blade 30 forms a part of the first delivery passage 5 and closes the opening 8*a* of the second delivery passage 8.

In contrast, when the blade 30 moves backward and is located at the second position, the blade 30 opens the second delivery passage 8. In this embodiment, an upstream side end 300*a* of the upper guide member 300 forming the second delivery passage 8 is bent upward so as to readily receive the original documents. The route from the introductory passage 2 to the second delivery passage 8 becomes a straight passage as well as the first embodiment, so that the original documents are hardly introduced mistakenly into the first delivery passage 5.

With this embodiment, a delivery roller pair 36, constituted of a driving roller 36*a* and a driven roller 36*b*, is placed at a midway of the second delivery passage 8, thereby smoothly conveying the original documents.

FIG. 6(*b*) shows a sliding mechanism for the blade 30. The sliding mechanism is constituted so that shafts 30*c*, 30*c* formed on both sides of the blade 30 are made to fit respective long holes 501 opened at a portion of a frame 500 (only one side thereof is shown.) of the apparatus body and so that the blade 30 can slide back and forth along the long holes 501 as guides. The shafts 30*c*, 30*c* are attached to plungers PL, PL, as drivers of the blade 30, and attached to springs 30*a*, 30*b* on the opposite side of the plungers side. Consequently, the blade 30 is normally urged toward the side of the reading position B according to elastic force of the springs 30*a*, 30*b*. Upon the operation of the plungers PL, PL, the blade 30 moves back to open the delivery passage 8. To the contrary, by stopping the operation of plungers PL, PL, the springs 30*a*, 30*b* make the blade 30 move forward, thereby forming passage connecting to the first delivery passage 5 and closing the delivery passage 8.

It is to be noted that the construction above can as a matter of course be applicable to the apparatus of the second embodiment in which the second delivery passage becomes the reverse introductory passage.

Figure 7:
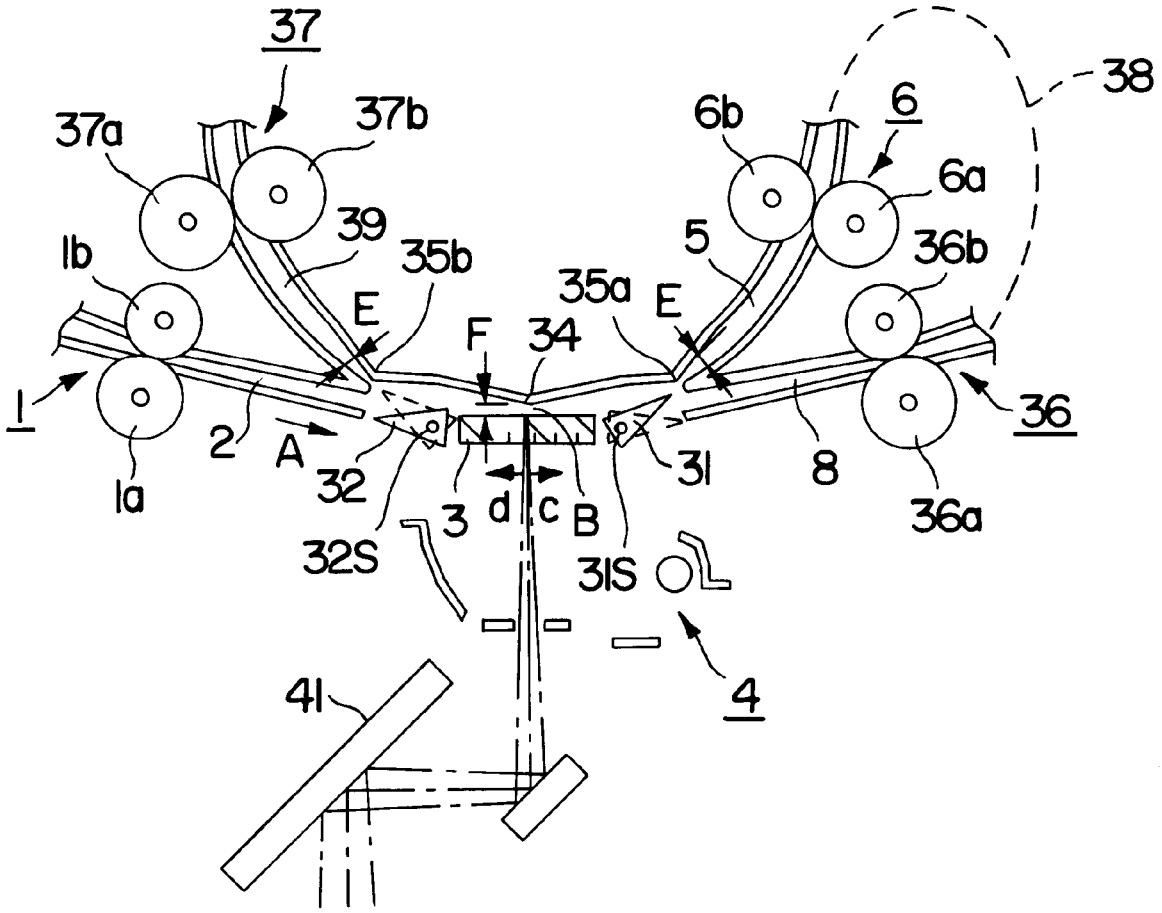
FIG. 7 is a side cross section showing an original document feeding apparatus according to a fifth embodiment of the invention.

Referring to FIG. 7, constitution of an original document feeding apparatus according to a fifth embodiment is described. This embodiment relates to an apparatus reducing vibrations occurring to the original documents being carried and eliminating reading defects of image information due to image distortions, by means of providing a reverse delivery passage in addition to the introductory passage and of providing original document pushing members at the introductory passage and the reverse delivery passage. It is to be noted that portions indicating the same portion in the drawings and having the same function as those of the first embodiment above are given the common reference numbers to omit their descriptions.

The original document feeding apparatus of this embodiment is formed with a second delivery passage 39 in addition to the introductory passage 2. A reverse delivery roller pair 37 composed of a driving roller 37*a* and a driven roller 37*b* is attached at a midway of the second delivery passage 39. As modified thus, not only a flap 31 is arranged on a downstream side of the reading position B in the original document conveyance direction indicated by an arrow c but also a flap 32 is arranged on the downstream side in the original document conveyance direction indicated by an arrow d. The flap 31 switches conveyance routes by pivoting about pivot 315 between the first delivery passage 5 and the reverse introductory passage 8, as well as the flaps 7 (shown in FIG. 1) of the first to third embodiments. The additional flap 32 switches conveyance routes by pivoting about pivot 325 between the introductory passage 2 and the second delivery passage 39. That is, when an image formed on a front face of an original document is to be read, the flaps 31, 32 are set to respective positions indicated by solid lines in FIG. 7; when an image formed on a back side of an original document is to be read, the flaps 31, 32 are set to respective positions indicated by broken lines.

A reading guide member 34 is formed by projecting a part of the conveyance route toward the platen glass 3 so as to create a clearance F at the reading unit of this embodiment. An original document pushing member 35*b* creating a clearance E in a direction perpendicular to the original document conveyance direction, is formed at a midway of the delivery passage 8 on the downstream side of the reading position B and between the reading position 1 and the conveyance roller pair 6.

In the original document feeding apparatus, the original documents are conveyed by the introductory roller pair 1 in a direction indicated by the arrow c, and an image on one side of the original document is read by passing the original document over the reading position B. At that time, the reading guide member 34 prevents the original documents from being disordered by restriction of the original documents being carried. According to experiments conducted by the inventors of this invention, it is turned out that the clearance F is preferably in a range of approximately 0.5 to 1.0 mm when cardboard (200 to 250 g/m2) or original documents attaching other paper are supposed to be used. If the clearance F is set to the length above, the original documents never act as load where introduced.

The apparatus can further suppress adverse influences against the original documents at the reading position B down to the minimum, because the original document pushing member 35*a* located at a midway of the first delivery passage 5 reduces disorders of the original documents being carried and reduces shocks when the original documents enter into the delivery roller pair 6. It is to be noted that bending of the original documents may occur in the introductory roller pair 2 in the case where the conveyance speed of the introductory roller pair 1 is higher than the conveyance speed of the delivery roller 6. In such a case, it is desirable to set that the conveyance speed of the delivery roller pair 6 becomes a little higher than the, conveyance speed of the introductory roller pair 1, because it is impossible to reduce shocks accompanied with releases of bending.

The image on the other side of the original document is read when the original document passes a reverse passage 38 and the reverse introductory passage 8 and then passes over the reading position B. At that time, similarly, the apparatus can reduce adverse influences against image reading procedure, because the original document pushing member 35*b* located at a midway of the second delivery passage 39 reduces disorders of the original documents being carried and reduces shocks when the original documents enter into the reverse delivery roller pair 37.

As described above, the original document feeding apparatus according to the embodiment transfers the original documents by the respective introductory roller pairs 1, 36 and the respective delivery roller pairs 6, 37 when the images formed on both sides of the original document are to be read. Although the reading guide member 34 creating the clearance F is formed at the reading position B and the original document pushing member 35*a*, 35*b* creating the clearance E are formed at the delivery passages 5, 39, respectively, as described above, it is possible, by setting the relation between the clearances E, F to be F≧E to restrict the original document at the reading position B to reduce disorders of the original documents, and to reduce shocks when the original documents being carried enter into the delivery roller pairs.

In a case even where the original documents are conveyed in the directions of the arrows c, d of the reading position B and where it is set that the conveyance speed is high and that original document interval is small, the apparatus is widely applicable by properly setting the clearances E, F since the reading guide member 34 is fixed. The pushing member 10 in FIG. 5 operates as well.

Figure 8:
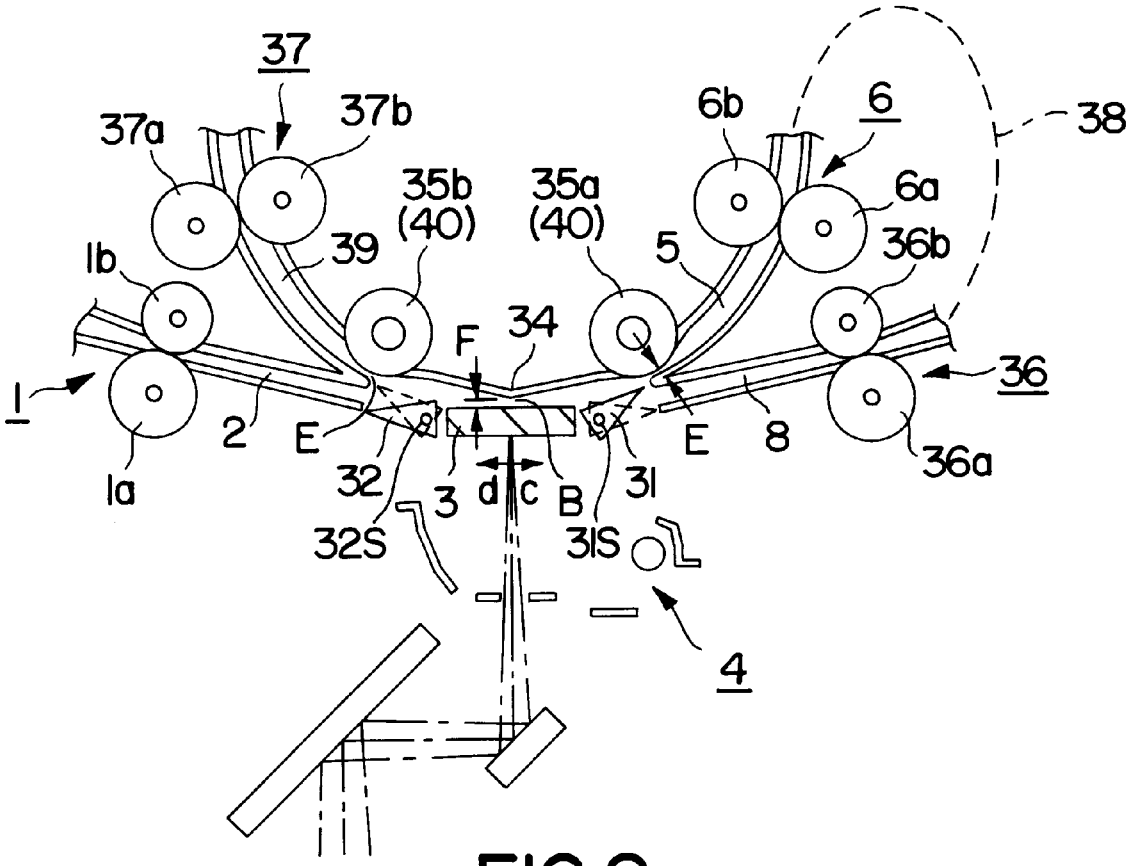
FIG. 8 is a side cross section showing an original document feeding apparatus according to a sixth embodiment of the invention.

Referring to FIG. 8, another original document feeding apparatus according to a sixth embodiment is described. The original document feeding apparatus in FIG. 8 is formed with runners 40, serving as rotary members, arranged at the respective original document pushing members 35*a*, 35*b* of the first delivery passage 5 and the second delivery passage 39. The runners 40 are rotatably held at the apparatus body and are constituted so that when contacting the original document being carried the runners 40 can rotate according to the conveyance of the original documents. It is possible to reduce conveyance load on the original documents by providing the runners 40 at the respective original document pushing members 35*a*, 35*b* of the delivery passage 5 and the second delivery passage 39.

In the embodiments described above, the clearances E, F are not restricted, and can be set in accordance with conveyance speed, size, and thickness of the original documents and with conditions as to whether the conveyance direction when the original document is read is one way or two ways.

The driving method of the roller pairs 1, 6, 36, 37, as well as the first embodiment, is performed by independently connecting respective motors not shown with the respective driving rollers 1*a*, 6*a*, 36*a*, 37*a*. Since the direct drive method applies to the respective reverse roller pairs 36, 37, the apparatus can eliminate causes of shock occurrences at a time that the original document is entered or released.

Similarly, the surfaces of the driving rollers 36*a*, 37*a* of the respective reverse roller pairs 36, 37, as well as the respective roller pairs 1, 6 shown in FIG. 3, make spines composed of alumina or the like adhere thereto, and the rollers are constituted so that the original documents can certainly be conveyed with designated speed.

Figure 9:
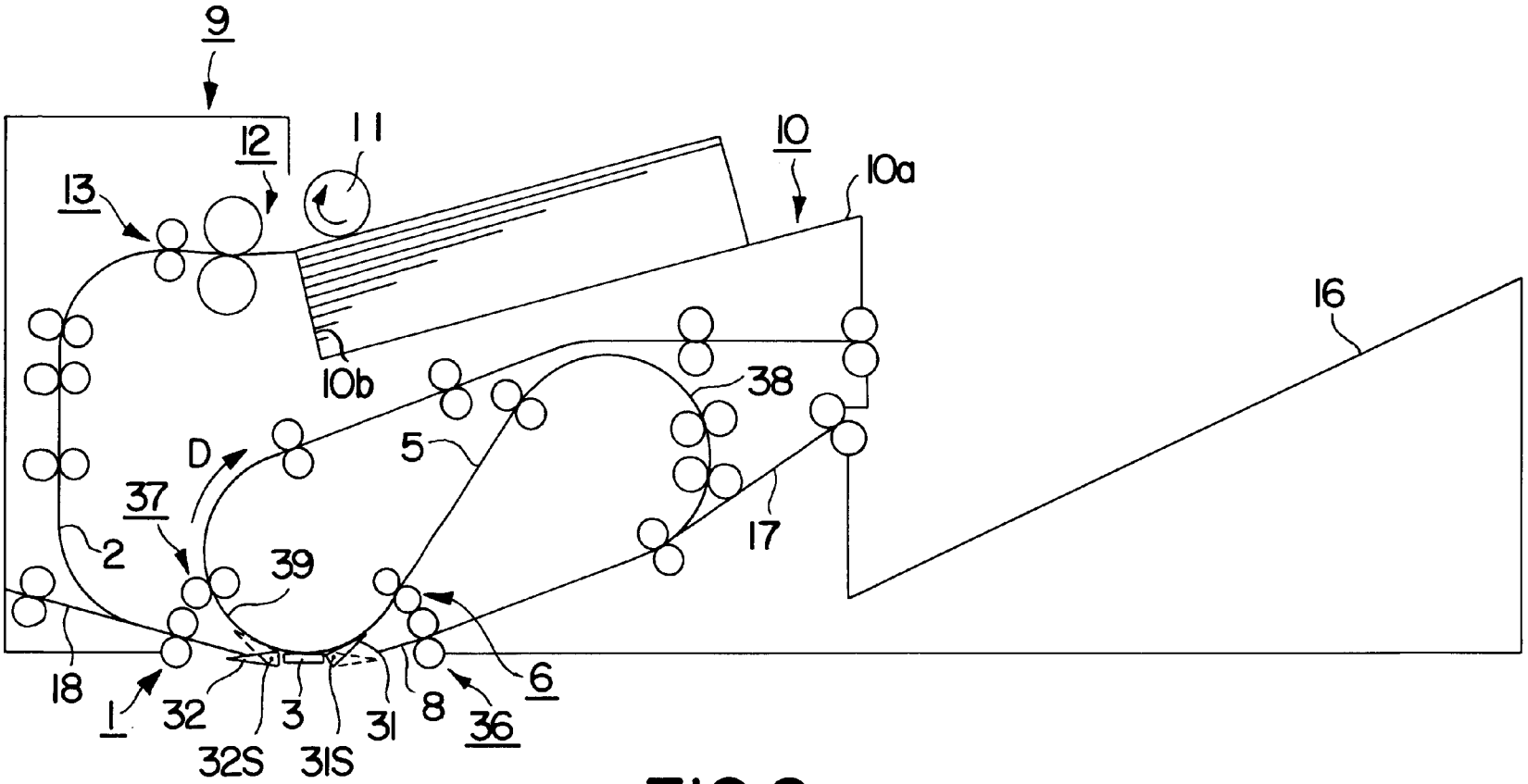
FIG. 9 is an illustration showing operation of the original document feeding apparatuses in fifth and sixth embodiment.

Referring to FIG. 9, entire constitution of the original document feeding apparatuses according to the fifth and sixth embodiments is described. As described above, these original document feeding apparatuses arrange the respective flaps 31, 32 on both sides of the platen glass 3 and are constituted so as to read images formed on both sides of the original document by reversing the original document and conveying it in directions of two ways at the reading position B. Its operation is the same as that in FIG. 3, so its description is omitted here.

Figure 10:
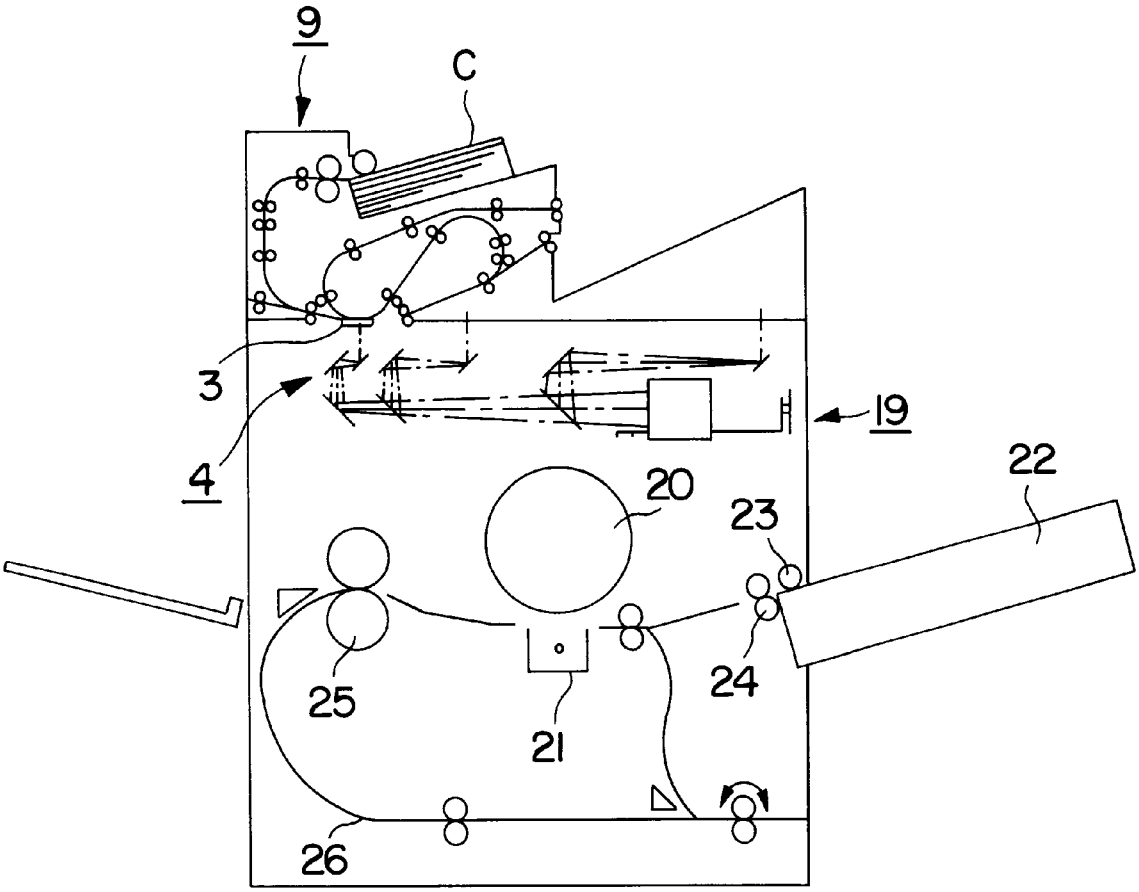
FIG. 10 is a side cross section showing constitution of an image forming apparatus incorporating the original document feeding apparatus according to one of first to sixth embodiments.

The original document feeding apparatus 9 of the respective embodiments can as shown in FIG. 10 be set in an apparatus body 19 of an image forming apparatus such as a photocopier. In FIG. 10, an example is shown in which the original document feeding apparatus in FIG. 3 or FIG. 9 is installed. In FIG. 10, the numeral 20 is a photosensitive body; the numeral 21 is a transfer charger; the numeral 22 is a feeding cassette; the numeral 23 is a feeding roller; the numeral 24 is a separation roller; the numeral 25 is a fixing device; and the numeral 26 is a double side passage.

In the image forming apparatus, light rays corresponding to the image of the original document are emitted onto the photosensitive body 20 to form a latent image, and then a toner image is formed by toner supplied from a toner supplier not shown. The feeding roller 23 is driven in synchrony with the formation of the toner image on the photosensitive body 20, and a recording medium such as a paper or a synthetic resin film contained in the feeding cassette 22 is supplied. The recording medium is conveyed to a position opposing to the photosensitive body 20 while the separation roller 24 prevents the original documents from being doubly fed, and the toner image on the photosensitive body 20 is transferred by the transfer charger 21. The recording medium being with the transferred toner image is then sent to the fixing device 25 to fix the toner image. Where images are formed on both sides of the recording medium, the recording medium with the toner image of one side fixed by the fixing device 25 passes through the double side passage 26 and is sent between the photosensitive body 20 and the transfer charger 21, thereby being formed with the toner image on its back side. The toner image is fixed by the fixing device 25 and is then delivered out of the apparatus.

It is to be noted that although in the embodiments above the reading apparatus is exemplified, other apparatuses can be used. For example, this invention can apply to a recording apparatus if the reading portion including the platen glass 3 is substituted for typing or printing means.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What we claimed is:

1. A sheet feeding apparatus comprising:

an introductory passage for introducing a sheet to a designated position;

a first delivery passage for delivering said sheet from said designated position;

a second delivery passage for branching off from said first delivery passage and delivering another sheet to said designated position; and conveyance route switching means selectively movable between a first position for forming one guide member of said first delivery passage and introducing said sheet to said first delivery passage and a second position disposed apart from said first delivery passage for forming one guide member of said second delivery passage and introducing said another sheet to said designated position without projecting in the first delivery passage, wherein said conveyance route switching means supports a switching member so as to be pivotable on an upstream side in a sheet conveyance direction in said first delivery passage and shifts to one of said first position and said second position by moving a downstream end in a sheet conveyance direction of said switching member and said switching member shifts from said first position to said second position as said sheet is passing by a downstream end of said switching member.

2. A sheet feeding apparatus comprising:

an introductory passage for introducing a sheet to a designated position;

a delivery passage for delivering said sheet from said designated position;

a reverse passage connected to one end of said delivery passage for reversing front and back sides of said sheet;

a reverse introductory passage connected to the other end of said reverse passage for reintroducing said reversed sheet to said designated position; and conveyance route switching means arranged at a branching off point between said delivery passage and said reverse introductory passage for selectively switching to take a first position for forming one guide member of said delivery passage and introducing said sheet to said delivery passage and a second position disposed apart from said delivery passage for forming one guide member of said reverse introductory passage and introducing said sheet from said reverse introductory passage to said designated position without projecting in said delivery passage, wherein said conveyance route switching means supports a switching member so as to be pivotable on an upstream side in a sheet conveyance direction in said delivery passage and shifts to one of said first position and said second position by moving a downstream end in a sheet conveyance direction of said switching member and said switching member shifts from said first position to said second position as said sheet is passing by a downstream end of said switching member.

3. An original document feeding apparatus comprising:

an introductory passage for introducing an original document to a reading position of image information of the original document;

a first delivery passage for delivering the original document from the reading position;

a second delivery passage branching off from said first delivery passage and delivering another original document to the reading position; and conveyance route switching means selectively movable between a first position for forming one guide member of said first delivery passage and introducing the original document to said first delivery passage and a second position disposed apart from said first delivery passage for forming one guide member of said second delivery passage and introducing said another original document to said reading position without projecting in the first delivery passage, wherein said conveyance route switching means supports a switching member so as to be pivotable on an upstream side in an original document feeding direction in said first delivery passage and shifts to one of said first position and said second position by moving a downstream end in the original document feeding direction of said switching member and said switching member shifts from said first position to said second position as said original document is passing by a downstream end of said switching member.

4. An original document feeding apparatus as set forth in claim 3, wherein said switching member is constituted so that a longitudinal direction of a flat board is arranged in parallel with a widthwise direction of the conveyance route, that one end in the longitudinal direction of the flat board is pivotably supported at an upstream side in the original document conveyance direction so as to allow the other end of the flat board turn around.

5. An original document feeding apparatus as set forth in claim 3, wherein said switching member selectively moves between a first position, by making the switching member go forward, for disconnecting the introductory passage with said second delivery passage and for connecting the introductory passage with said first delivery passage or a second position, by making the switching member go backward, for connecting said introductory passage with said second delivery passage.

6. An original document feeding apparatus as set forth in claim 3, wherein reading of the image information of the original documents at the reading position is performed by fixing an optical system to said reading position and by rendering the original documents pass through said reading position.

7. An original document feeding apparatus as set forth in claim 6, further comprising at said reading position of image information of the original document an original document pushing member creating a clearance equivalent to or a little narrower than an original document passing interval at said reading position.

8. An original document feeding apparatus as set forth in claim 7, further comprising a rolling member supported, so as to be rotatable when driven, to said original document pushing member of said delivery passage.

9. An original document feeding apparatus as set forth in claim 3, further comprising introductory means for introducing the original document arranged at said introductory passage and delivery means for delivering the original document arranged at said first and second delivery passages, whereby said introductory means and said delivery means are directly connected to respective output shafts of drive sources independent from each other to transfer their drive power.

10. An original document feeding apparatus as set forth in claim 9, wherein said introductory means and said delivery means are constituted of respective roller pairs, composed of respective driving and driven rollers, for clamping the original document by pressing with designated pressure to convey it, and wherein alumina grains are made to fixedly adhere to the surfaces of said driving rollers of said roller pairs and elastic bodies are formed on the surfaces of said driven rollers of said roller pairs.

11. An original document feeding apparatus comprising:

an introductory passage for introducing an original document to a reading position for reading image information of said original document;

a delivery passage for delivering said original document from said reading position;

a reverse passage, connected to an end of said delivery passage, for reversing front and back sides of said original document;

a reverse introductory passage, connected to the other end of said reverse passage, for reintroducing said reversed original document to said reading position; and conveyance route switching means, arranged at a branching off point between said delivery passage and said reverse introductory passage, for selectively switching to take a first position for forming one guide member of said delivery passage and introducing said original document to said reverse passage and a second position disposed apart from said delivery passage for forming one guide member of said reverse introductory passage and introducing said original document from said reverse introductory passage to said reading position without projecting in the delivery passage, wherein said conveyance route switching means supports a switching member so as to be pivotable on an upstream side in an original document feeding direction in said delivery passage and shifts to said first position or said second position by moving a downstream end in the original document feeding direction of said switching member and said switching member shifts from said first position to said second position as said original document is passing by a downstream end of said switching member.

12. An original document feeding apparatus as set forth in claim 11, wherein said switching member is constituted so that a longitudinal direction of a flat board is arranged in parallel with a widthwise direction of the conveyance route, that one end in the longitudinal direction of the flat board is pivotably supported at an upstream side in the original document conveyance direction so as to allow the other end of the flat board turn round.

13. An original document feeding apparatus as set forth in claim 11, wherein reading of the image information of the original documents at the reading position is performed by fixing an optical system to said reading position and by rendering the original documents pass through said reading position.

14. An original document feeding apparatus as set forth in claim 11, further comprising introductory means for introducing the original document arranged at said introductory passage, delivery means for delivering the original document arranged at said delivery passage, and reverse introductory means for introducing the original document arranged at said reverse introductory passage, whereby said introductory means, said delivery means and said reverse introductory means are directly connected to respective output shafts of drive sources independent from each other to transfer their drive power.

15. An original document feeding apparatus as set forth in claim 14, wherein said introductory means, said delivery means, and said reverse introductory means are constituted of respective roller pairs, composed of respective driving and driven rollers, for clamping the original document by pressing with designated pressure to convey it, and wherein alumina grains are made to fixedly adhere to the surfaces of said driving rollers of said roller pairs and elastic bodies are formed on the surfaces of said driven rollers of said roller pairs.

16. An original document feeding apparatus as set forth in claim 11, wherein said delivery passage constitutes a first delivery passage and further comprising:

a second delivery passage for delivering the original document introduced through said reverse introductory passage to said reading position, as an additional passage to said introductory passage, and a second conveyance route switching means, arranged at a branching off point between said introductory passage and said second delivery passage, for selectively switching to take a first position for introducing said original document from said introductory passage to said first delivery passage or a second position for introducing said original document from said reverse introductory passage to said second delivery passage.

17. An original document feeding apparatus as set forth in claim 16, further comprising at said reading position of image information of the original document an original document pushing member creating a clearance a little narrower than an original document passing interval at said reading position.

18. An original document feeding apparatus as set forth in claim 16, further comprising delivery means arranged at said first delivery passage, delivery means arranged at said second delivery passage, and original document pushing members, arranged between said reading position and said delivery means and between said reading position and said delivery means, creating a clearance equivalent to or a little narrower than an original passing interval at said reading position.

19. An original document feeding apparatus as set forth in claim 16, further comprising introductory means for introducing the original document arranged at said introductory passage, delivery means for delivering the original document arranged at said first delivery passage, reverse introductory means for introducing the original document arranged at said reverse introductory passage, and reverse delivery means for introducing the original document arranged at said second delivery passage, whereby said introductory means, said delivery means, said reverse introductory means, and said reverse delivery means are directly connected to respective output shafts of drive sources independent from each other to transfer their drive power.

20. An original document feeding apparatus as set forth in claim 19, wherein said introductory means, said delivery means, said reverse introductory means, and said reverse delivery means are constitute of respective roller pairs, composed of respective driving and driven rollers, for clamping the original document by pressing with designated pressure to convey it, and wherein alumina grains are made to fixedly adhere to the surfaces of said driving rollers of said roller pairs and elastic bodies are formed on the surface of said driven rollers of said roller pairs.

21. An image forming apparatus comprising:

an original document feeding apparatus comprising: an introductory passage for introducing an original document to a reading position of image information of said original document; a first delivery passage for delivering said original document from the reading position; a second delivery passage branching off from said first delivery passage and for delivering another original document to said reading position; conveyance route switching means selectively movable between a first position forming one guide member of said first delivery passage and for introducing said original document to said first delivery passage and a second position disposed apart from said first delivery passage for forming one guide member of said second delivery passage and introducing said original document to said reading position without projecting in the first delivery passage; and wherein said conveyance route switching means supports a switching member so as to be pivotable on an upstream side in an original document feeding direction in said first delivery passage and shifts to said first position or said second position by moving a downstream end in the original document feeding direction of said switching member and said switching member shifts from said first position to said second position as said original document is passing by a downstream end of said switching member, a reading unit for reading images of said original documents sent by said original document feeding apparatus; and an image forming unit for forming images on recording media corresponding to images as read at said reading unit.

22. An image forming apparatus comprising:

an original document feeding apparatus comprising: an introductory passage for introducing an original document to a reading position for reading image information of said original document; a delivery passage for delivering said original document from said reading position; a reverse passage, connected to an end of said delivery passage, for reversing front and back sides of said original document; a reverse introductory passage, connected to the other end of said reverse passage, for reintroducing said reversed original document to said reading position; conveyance route switching means, arranged at a branching off point between said delivery passage and said reverse introductory passage, for selectively switching to take a first position for forming one guide member of said delivery passage and introducing said original document to said reverse passage and a second position disposed apart from said delivery passage for forming one guide member of said reverse introductory passage and introducing said original document from said reverse introductory passage to said reading position without projecting in said delivery passage; and wherein said conveyance route switching means supports a switching member so as to be pivotable on an upstream side in an original document feeding direction in said delivery passage and shifts to said first position or said second position by moving a downstream end in the original document feeding direction of said switching member and said switching member shifts from said first position to said second position as said original document is passing by a downstream end of said switching member, a reading unit for reading images of said original documents sent by said original document feeding apparatus; and an image forming unit for forming images on recording media corresponding to images as read at said reading unit.

23. A sheet feeding apparatus comprising:

an introductory passage for introducing a sheet to a designated position;

a first delivery passage for delivering said sheet from said designated position;

a second delivery passage connected to said first delivery passage for reintroducing a sheet to said designated position;

conveyance route switching means arranged at a meeting point between said first delivery passage and said second delivery passage for selectively switching between a first position to form a guide member for said first delivery passage and for introducing said sheet to said first delivery passage and a second position disposed apart from said first delivery passage for forming a guide member of said second delivery passage introducing said sheet from said second delivery passage to said designated position without projecting into said first delivery passage;

wherein said conveyance route switching means supports a switching member so as to be pivotable on an upstream side in a sheet conveyance direction in said first delivery passage and shifts to said first position or said second position by moving a downstream end in the sheet conveyance direction of said switching member and said switching member shifts from said first position to said second position as said sheet is passing by a downstream end of said switching member.

24. A sheet feeding apparatus as set forth in claim 23, wherein said sheet introduced along said first delivery passage is re-introduced to said designated position in reversed condition of the two surfaces of said sheet through said second delivery passage.

25. A sheet feeding apparatus as set forth in claim 24, wherein said designated position is a reading position.

26. A sheet feeding apparatus as set forth in claim 25, wherein said sheet introduced from said second delivery passage is introduced to a discharge position from said introductory passage after passing said reading position.

27. A sheet feeding apparatus as set forth in claim 26, wherein a conveyance roller pair is disposed in said first delivery passage and said switching member shifts after front end of said sheet is nipped by said conveyance roller pair.

28. A sheet feeding apparatus as set forth in claim 26, wherein said first delivery passage extends upward at downstream side of said reading position and said second delivery passage extends straight toward said reading position.

29. A sheet feeding apparatus as set forth in claim 28, said switching member is a flap which leads upward said sheet to said first delivery passage in the first position, and leads laterally said sheet to said reading position in the second position wherein said flap is positioned between said reading position and said second delivery position.

* * * * *

UNITED STATES PATENT AND TRADEMARK OFFICE

CERTIFICATE OF CORRECTION

PATENT NO. : 5,953,574

DATED : September 14, 1999

INVENTOR(S) : TAMOTSU OKADA

It is certified that error appears in the above-identified patent and that said Letters Patent is hereby corrected as shown below:

COLUMN 2:

Line 6, "different,from" should read --different from--.

COLUMN 3:

Line 4, "each;" should read --each--; and

Line 13, "view." should read --view;--.

COLUMN 7:

Line 25, "elasity" should read --elasticity--; and

Line 30, "mush" should read --much--.

COLUMN 9:

Line 50, "the," should read --the--.

COLUMN 13:

Line 2, "turn" should read --to turn--; and

Line 16, "pass" should read --to pass--.

UNITED STATES PATENT AND TRADEMARK OFFICE

CERTIFICATE OF CORRECTION

PATENT NO. : 5,953,574

DATED : September 14, 1999

INVENTOR(S) : TAMOTSU OKADA

It is certified that error appears in the above-identified patent and that said Letters Patent is hereby corrected as shown below:

COLUMN 14:

Line 19, "turn" should read --to turn--; and

Line 24, "pass" should read --to pass--.

COLUMN 15:

Line 27, "constitute" should read --constituted--.

Signed and Sealed this

Twenty-sixth Day of September, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,953,574
DATED : September 14, 1999
INVENTOR(S) : Tamotsu Okada

It is certified that error appears in the above-identified patent and that said Letters Patent is hereby corrected as shown below:

Title page, at Item [30] :
Insert -- [30] Foreign Application Priority Data
Dec. 17, 1993 [JP] Japan...5-318467
Dec. 17, 1993 [JP] Japan...5-318473 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*